US006802304B1

(12) United States Patent
Chang

(10) Patent No.: US 6,802,304 B1
(45) Date of Patent: Oct. 12, 2004

(54) TRIGGER ASSEMBLY WITH A SAFETY DEVICE FOR A CROSSBOW

(76) Inventor: Chu-Wei Chang, No. 4, Lane 855, Sec. 2, Feng-Shih Rd., Feng-Yuan City, Taichung Hsien (TW)

( * ) Notice: Subject to any disclaimer, the term of this patent is extended or adjusted under 35 U.S.C. 154(b) by 0 days.

(21) Appl. No.: 10/761,091

(22) Filed: Jan. 20, 2004

(51) Int. Cl.[7] ..... F41B 5/12
(52) U.S. Cl. ..... 124/25; 124/40
(58) Field of Search ..... 124/25, 40

(56) References Cited

U.S. PATENT DOCUMENTS 4,192,281 A * 3/1980 King ..... 124/25
4,721,092 A * 1/1988 Waiser ..... 124/40
4,877,008 A * 10/1989 Troubridge ..... 124/25
5,085,200 A * 2/1992 Horton-Corcoran et al. .. 124/25
5,598,829 A * 2/1997 Bednar ..... 124/25
5,649,520 A * 7/1997 Bednar ..... 124/25
6,205,990 B1 * 3/2001 Adkins ..... 124/25
6,425,386 B1 * 7/2002 Adkins ..... 124/31
6,736,123 B1 * 5/2004 Summers et al. ..... 124/25

* cited by examiner

*Primary Examiner*—John A. Ricci
(74) *Attorney, Agent, or Firm*—Jackson Walker LLP

(57) ABSTRACT

A trigger assembly has a housing, a trigger, an actuating lever, a string holder, a bowstring catch biasing member, a safety pin, a safety lock, a pushing arm, a block, a block biasing member and a string stop. The housing has a mouth. The actuating lever has a hook and abuts against the top of the trigger. The bowstring catch has a string hook and a leg selectively engaging the hook on the actuating lever. The safety pin is moveably mounted in the housing and is supported on the actuating lever. The safety lock is moveably mounted in the housing and has a push rod. The pushing arm has a protrusion abutting the push rod. The block has a transverse rod selectively engaging the front end of the pushing arm. Accordingly, a trigger assembly with two safety features is provided.

12 Claims, 6 Drawing Sheets

TRIGGER ASSEMBLY WITH A SAFETY DEVICE FOR A CROSSBOW

BACKGROUND OF THE INVENTION

1. Field of the Invention

The present invention relates to a trigger assembly, and more particularly to a trigger assembly with a safety device for a crossbow, which provides two safety features.

2. Description of Related Art

A crossbow is a weapon that aims and shoots an arrow at a target. A conventional crossbow substantially comprises a stock, a bow, a bowstring and a trigger assembly. The stock has a front end and a rear end. The bow is transversely mounted on the front end of the stock and has two ends and at least two pulleys mounted respectively on the ends of the bow. The bowstring has two ends with a loop at each end. The loops are attached respectively to the ends of the bow, and the bowstring is mounted around the pulleys and is drawn toward the rear of the stock to propel an arrow when the bowstring is released. The trigger assembly is mounted on the stock and has a catch and a trigger. The catch holds the bowstring in the drawn position and is selectively held in place and released by the trigger. When the trigger is pulled, the drawn bowstring will be released from the catch and the arrow will be shot.

As a weapon, the crossbow has the potential to injure people accidentally. Therefore, a safety device is necessary to keep a crossbow from injuring people unintentionally. However, conventional crossbows usually do not have safety devices, so use of conventional crossbows is hazardous.

Some manufacturers have added a safety device to a conventional crossbow to improve the safety of the crossbow, but the conventional safety device in a crossbow is manual. A crossbow with a safety device is still dangerous when the user forgets to engage the safety device.

To overcome the shortcomings, the present invention provides a trigger assembly for a crossbow to mitigate or obviate the aforementioned problems.

SUMMARY OF THE INVENTION

The main objective of the invention is to provide a trigger assembly for a crossbow, which has a safety device that automatically engages when the bowstring is drawn and connected to the trigger assembly to improve the safety of the crossbow.

The trigger assembly has a housing, a trigger, an actuating lever, a string holder, a bowstring catch biasing member, a safety pin, a safety lock, a pushing arm, a block, a block biasing member and a string stop. The housing has a top, a bottom, a front end, a rear end, a side, a mouth transversely defined in the front end and a slot transversely defined through the side and parallel to the mouth. The trigger is pivotally mounted in the housing and has a top portion and a bottom portion that protrudes from the bottom of the housing. The actuating lever is pivotally mounted in the housing and abuts the top portion of the trigger. The actuating lever has a front end with a hook and a rear end. The bowstring catch is pivotally mounted in the housing and has a front end, a rear end, a string hook and a leg. The string hook is formed on the front end of the bowstring catch and corresponds to the mouth in the housing. The leg extends downward from the rear end of the bowstring catch and selectively engages the hook on the actuating lever. The bowstring catch biasing member is mounted in the housing and has an end connected to the bowstring catch to make the string hook of the bowstring catch retract from the mouth. The safety pin is moveably mounted in the housing and has a top and a bottom that is supported on the rear end of the actuating lever. The safety lock is moveably mounted in the housing and has a front end, a rear end and a push rod. The rear end of the safety lock corresponds to and selectively abuts the top of the safety pin. The push rod extends transversely from the safety lock and into the slot in the housing. The pushing arm is moveably mounted in the housing and has a bottom, a front end corresponding to the mouth in the housing, a rear end and a protrusion abutting the push rod on the safety lock. The block is pivotally mounted in the housing and has a transverse rod laterally extending from the block and selectively engaging the front end of the pushing arm. The block biasing member is mounted in the housing and is connected to the block to push the block into the mouth when the transverse rod on the block disengages from the front end of the pushing arm. The string stop is pivotally mounted on the housing, extends into the mouth and corresponds to the block.

Other objects, advantages and novel features of the invention will become more apparent from the following detailed description when taken in conjunction with the accompanying drawings.

DETAILED DESCRIPTION OF PREFFERED EMBODIMENT

Figure 1:
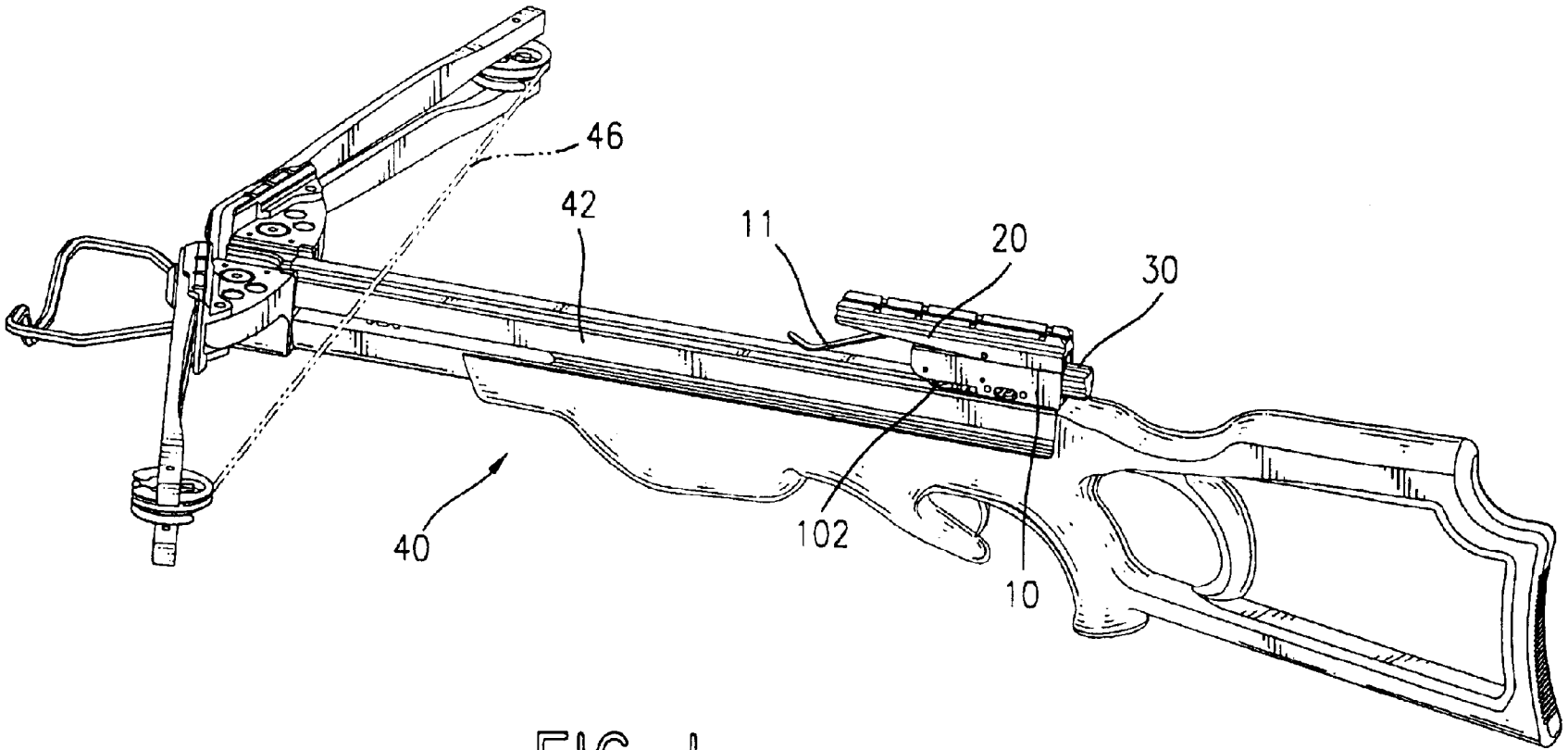
FIG. 1 is a perspective view of a crossbow with a trigger assembly in accordance with the present invention.
Figure 2:
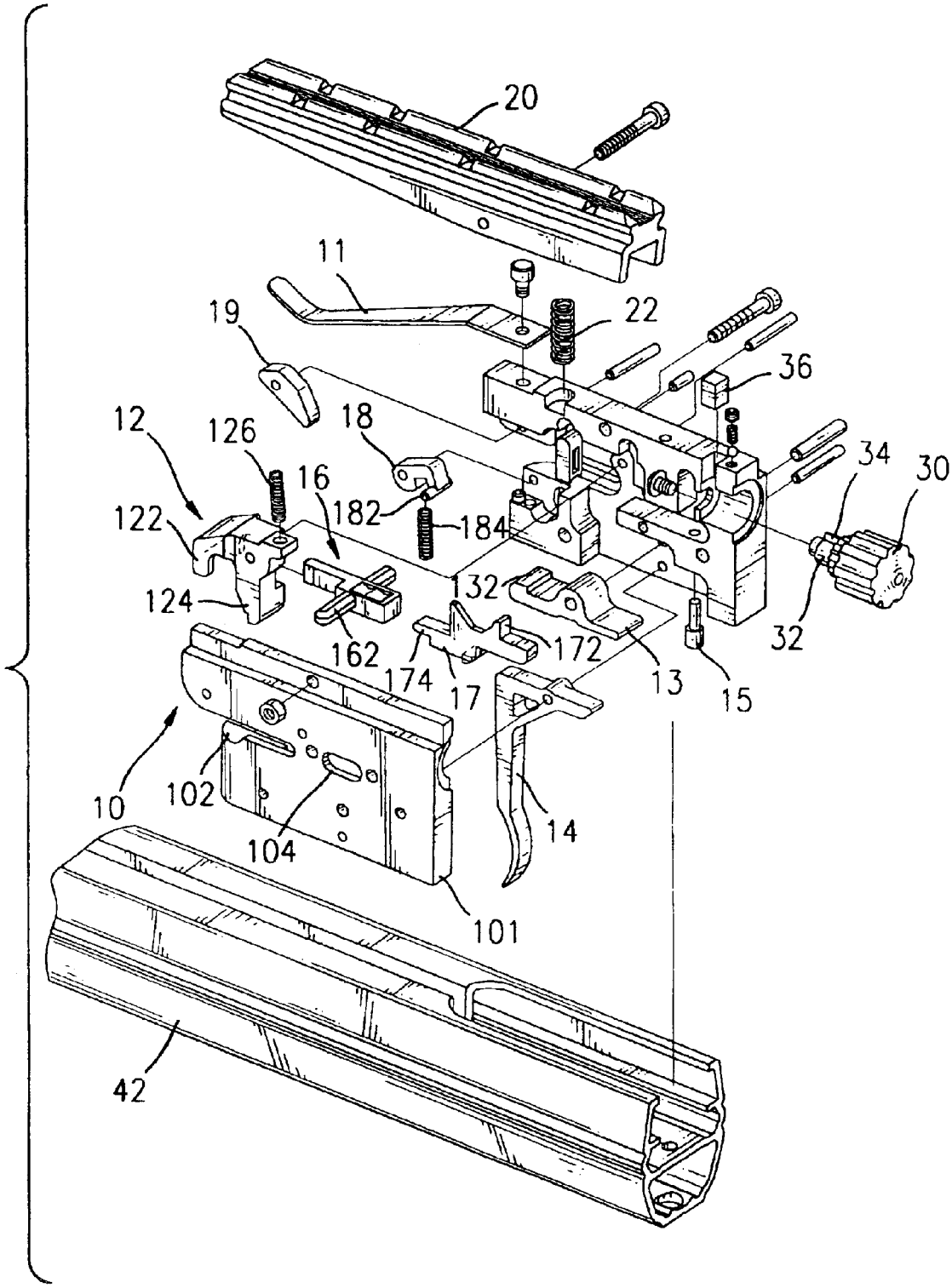
FIG. 2 is an exploded perspective view of the trigger assembly in FIG. 1.
Figure 3:
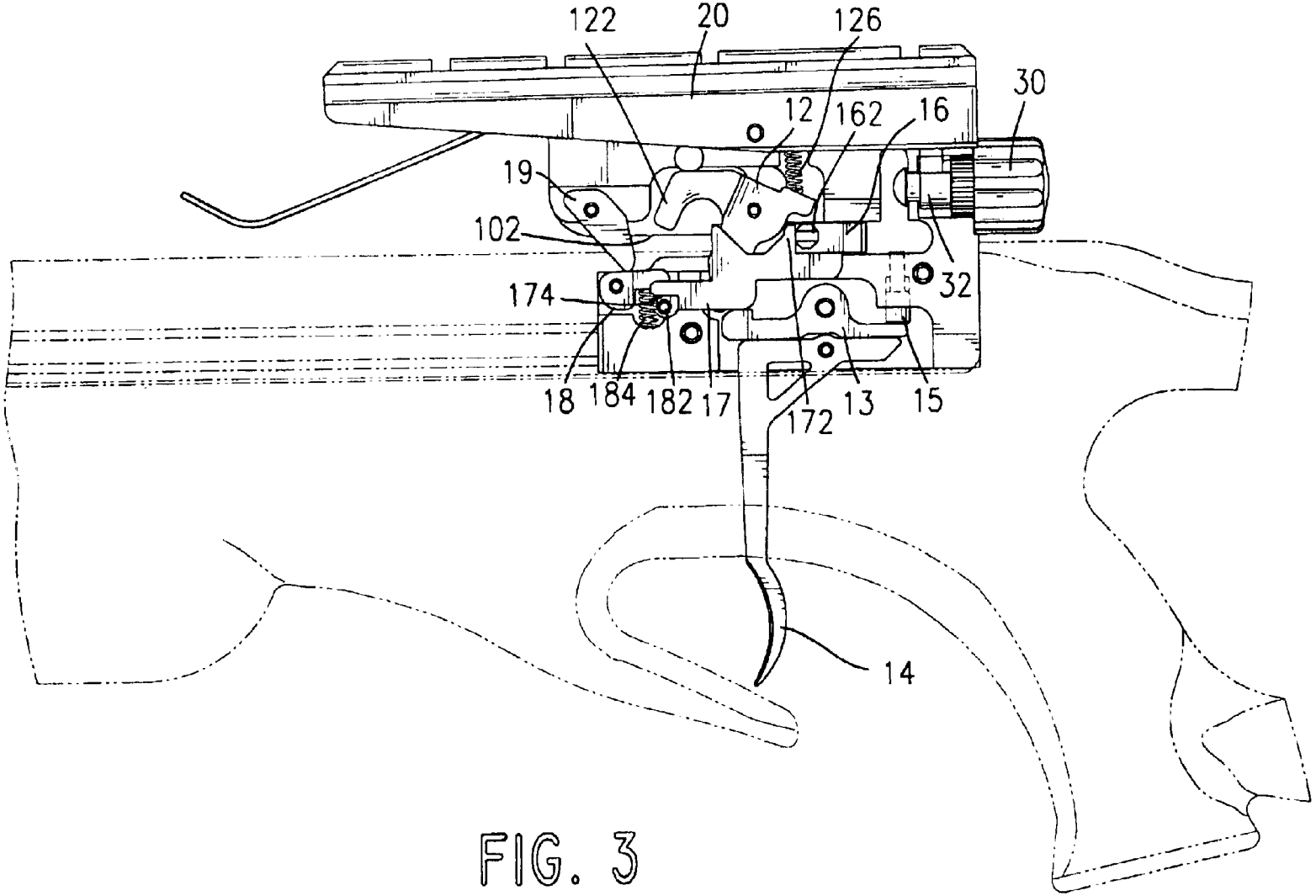
FIG. 3 is a side plan view of the trigger assembly in FIG. 2.

With reference to FIGS. 1 to 3, a trigger assembly in accordance with the present invention for a crossbow (40) having a stock (42) and a transverse bow (not numbered) with a bowstring (46) is mounted on the stock (42) and comprises a housing (10), a trigger (14), an actuating lever (13), a bowstring catch (12), a bowstring catch biasing member (126), a safety pin (15), a safety lock (16), a pushing arm (17), a block (18), a block biasing member (184), a string stop (19), an optional sight mount (20), an optional adjusting device (not numbered) and an optional resilient arrow retainer (1).

The housing (10) is mounted on the stock (42) and has a top (not numbered), a bottom (not numbered), a front end (not numbered), a rear end (not numbered), a side (not numbered), a mouth (102) and a slot (104). The mouth (102) is defined transversely in the front end and has a top (not numbered) and a bottom (not numbered). The slot (104) is defined transversely through the side and is parallel to the mouth (102). In an optional embodiment, the housing (10) is composed of two half shells (01) attached to each other.

The trigger (14) is mounted pivotally in the housing (10) and has a top portion (not numbered) and a bottom portion (not numbered) that protrudes out from the bottom of the housing (10).

The actuating lever (13) is mounted pivotally in the housing (10) and abuts the top portion of the trigger (14). The actuating lever (13) has a front end (not numbered) and a rear end (not numbered). The front end has a hook (132).

The bowstring catch (12) is mounted pivotally in the housing (10) and has a front end (not numbered), a rear end (not numbered), a string hook (122) and a leg (124). The string hook (122) is formed on the front end and corresponds to the mouth (102) in the housing (10). The leg (124) extends downward from the rear end and selectively engages the hook (132) on the actuating lever (13).

The bowstring catch biasing member (126) is mounted in the housing (10) between the top of the housing (10) and the bowstring catch (12). When the leg (124) disengages from the hook (132) on the actuating lever (13), the bowstring catch biasing member (126) pivots the string hook (122) of the bowstring catch (12) out of the mouth (102).

The safety pin (15) is mounted moveably in the housing (10) and has a top (not numbered) and a bottom (not numbered) that is supported on the rear end of the actuating lever (13). When the safety pin (15) is held securely in place, the trigger (14) cannot be pulled.

The safety lock (16) is mounted moveably in the housing (10) and has a front end (not numbered), a rear end (not numbered) and a push rod (162). The rear end of the safety lock (16) corresponds to and selectively abuts the top of the safety pin (15). The push rod (162) extends transversely from the safety lock (16) and out of the slot (104) in the housing (10), such that the safety lock (16) can be moved relative to the housing (10) along the slot (104) by means of pulling the push rod (162).

The pushing arm (17) is mounted moveably in the housing (10) and has a bottom (not numbered), a front end (not numbered), a rear end (not numbered), a protrusion (172) and an optional notch (174). The front end of the pushing arm (17) corresponds to the mouth (102) in the housing (10), and the protrusion (172) abuts the push rod (162) on the safety lock (16).

The block (18) is mounted pivotally in the housing (10) at the bottom of the mouth (102) and has a top (not numbered), a bottom (not numbered) and a transverse rod (182). The transverse rod (182) extends transversely from the 3 block (18) and is selectively engaged by the front end of the pushing arm (17). In an optional embodiment, the optional notch (174) defined in the bottom at the front end of the pushing arm (17) selectively engages the transverse rod (182) on the block (18).

The block biasing member (184) is mounted in the housing (10) between the block (18) and the bottom of the housing (10) to push the block (18) into the mouth (102) when the transverse rod (182) on the block (18) disengages from the front end of the pushing arm (17).

The string stop (19) is mounted pivotally in the housing (10) at the top of the mouth (102), extends into the mouth (102) and corresponds to the block (18). The string stop (19) will extend into the mouth due to the weight of the string stop (19).

Figure 4:
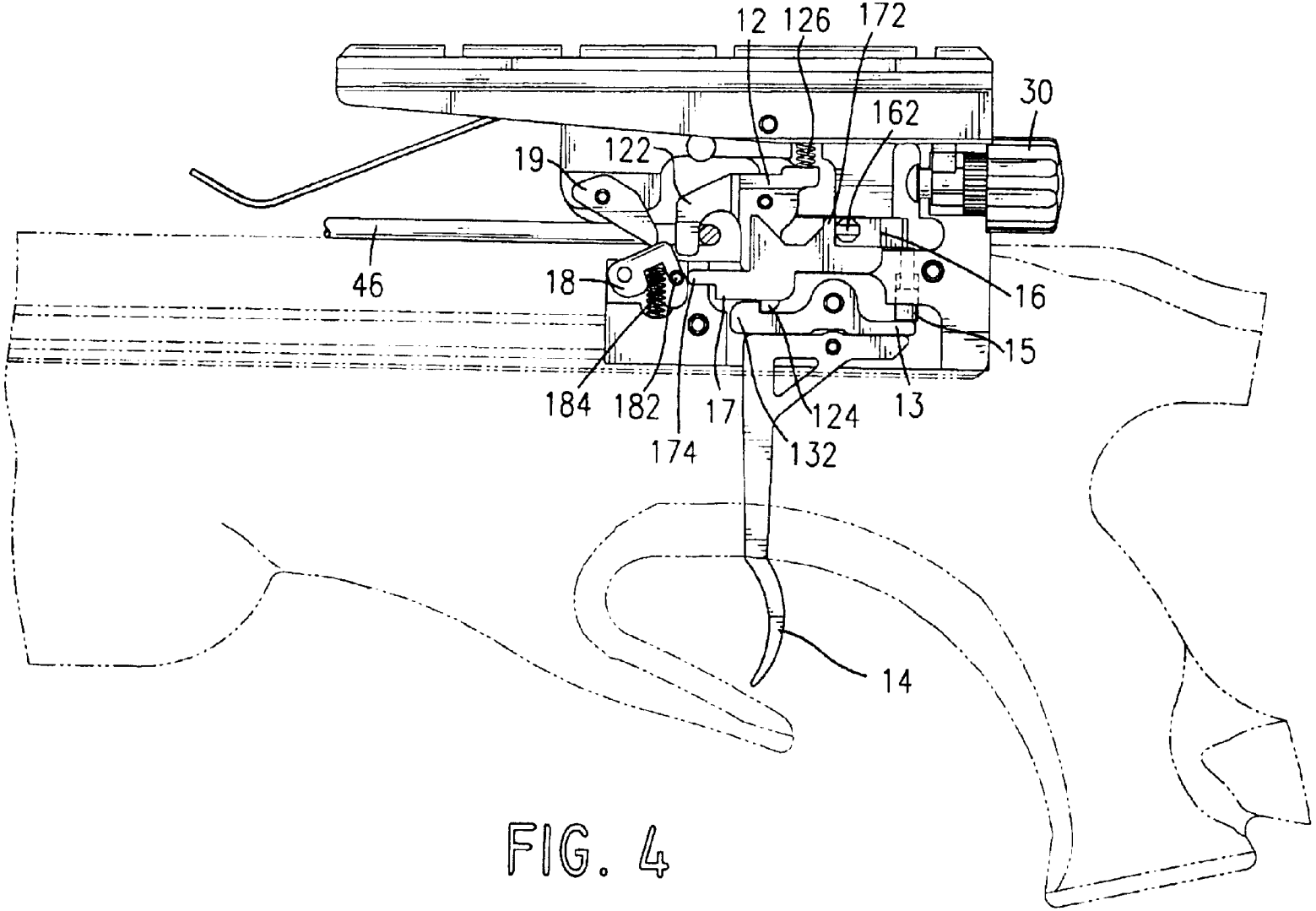
FIG. 4 is an operational side plan view of the trigger assembly in FIG. 3 with the bowstring hooked by the string hook.

With reference to FIGS. 2 to 4, when the bowstring (46) of the crossbow (40) is drawn and enters the mouth (102) of the housing (10), the bowstring catch (12) is pushed and pivots relative to the housing (10). The leg (124) on the bowstring catch (12) engages the hook (132) on the actuating lever (13), and the string hook (122) will hold the drawn bowstring (46) on the bowstring catch (12). The pushing arm (17) is moved simultaneously by the bowstring (46), and the protrusion (172) on the pushing arm (17) pushes the safety lock (16) along the slot (104). Accordingly, the rear end of the safety lock (16) abuts and holds the top of the safety pin (15) to keep the safety pin (15) from moving relative to the housing (10). With the safety pin (15) held in place, the actuating lever (13) and the trigger (13) are kept from rotating relative to the housing (10), and the drawn bowstring (46) is securely held on the bowstring catch (12) and cannot be released by pulling the trigger (14). Consequently, the trigger assembly is locked automatically, and the user cannot fire the crossbow (40).

When the pushing arm (17) moves toward the rear end of the housing (10), the transverse rod (182) on the block (18) will disengage from the notch (174) in the front end of the pushing arm (17). The block biasing member (184) will pivot the block (18) relative to the housing (10), and the top of the block (I 8) extends into the mouth (102). At this time, the transverse rod (182) on the block (18) abuts the front end of the pushing arm (17), such that the pushing arm (17) will not move to the front end of the housing (10). Accordingly, the user cannot push the safety lock (16) backward, such that the trigger assembly cannot be unlocked.

If the user releases the bowstring (46) before the bowstring (46) is engaged by the string hook (122) of the bowstring catch (12), the string stop (19) will stop the released bowstring (46) and keep the bowstring (46) from moving out of the mouth (102). This can keep the drawn bowstring (46) from be unintentionally released before an arrow is inserted into the crossbow (40). The limbs of the crossbow (40) can be kept from being damaged, and the useful life of the crossbow (40) is prolonged.

Figure 5:
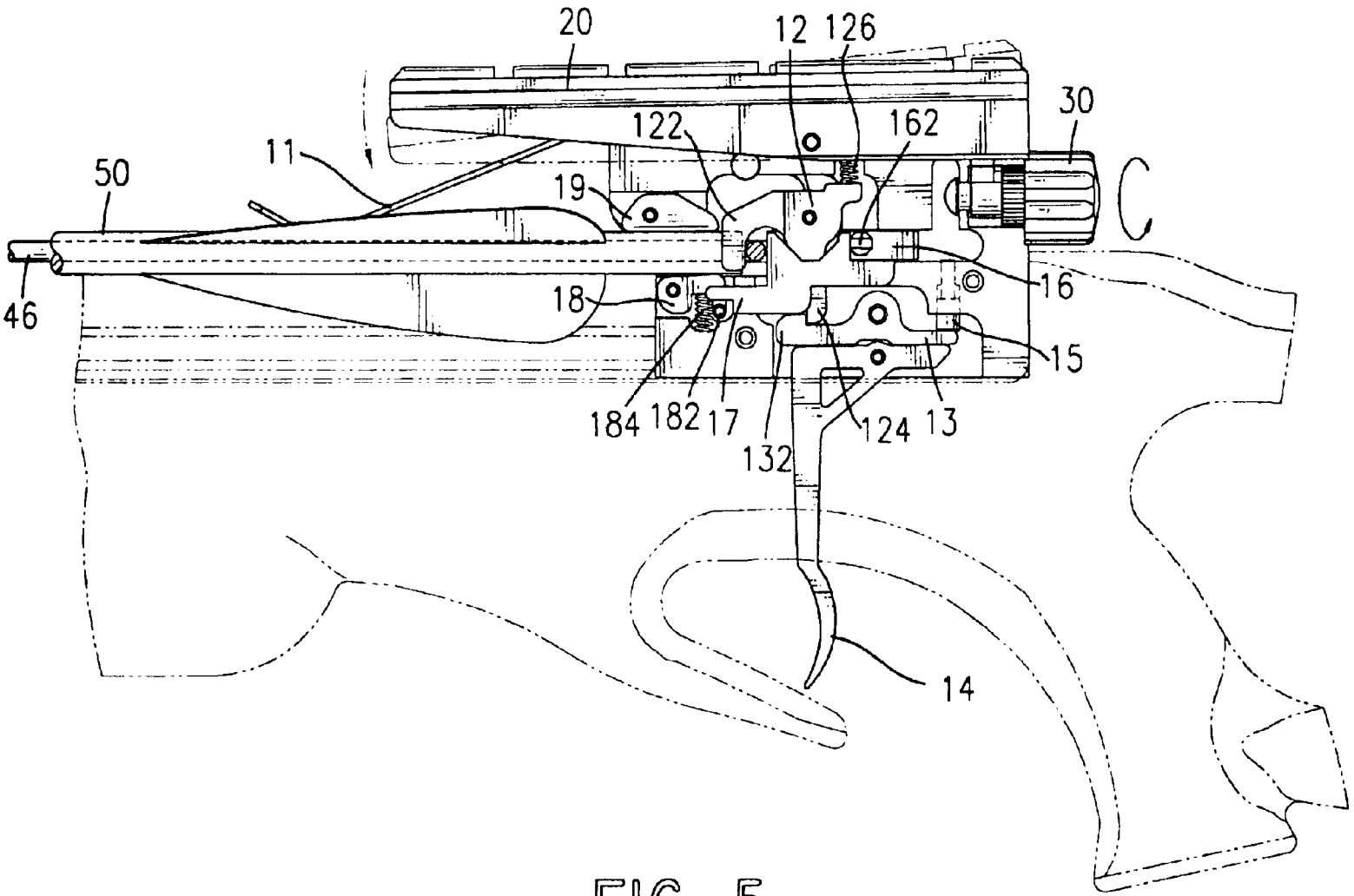
FIG. 5 is an operational side plan view of the trigger assembly in FIG. 3 with an arrow on the stock of the crossbow having pushed the block and the string stop away from the mouth in the housing.

With further reference to FIG. 5, inserting an arrow (50) into the crossbow will simultaneously push the top of the block (18) and the string stop (19) out of the mouth (10). The transverse rod (182) on the block (18) will leave the position where the transverse rod (182) abuts the front end of the pushing arm (17), such that the limitation to the movement of the pushing arm (17) is released. The user can push the safety lock (16) backward to make the rear end of the safety lock (16) disengage from the top of the safety pin (15). Consequently, the user can pull the trigger (14), and the trigger (14) and the actuating lever (13) pivots relative to the housing (10). The hook (132) on the actuating lever (13) unhooks the leg (124) on the bowstring catch (12), and the bowstring catch (12) pivots up relative to the housing (10) to release the bowstring (46) from the string hook (122). Accordingly, the drawn bowstring (46) is released, and the arrow (50) is fired from the crossbow (40).

The trigger assembly automatically locks when the bowstring (46) is drawn into the mouth (102) in the housing (10). This can keep a person from being injured unintentionally if the user forgets to lock the trigger assembly. Furthermore, the trigger assembly cannot be unlocked before an arrow (50) is inserted into the crossbow so the tightly drawn bowstring (46) cannot be released if no arrow is on the stock (42). This can keep the limbs of the crossbow (40) from being damaged, such that a second safety effect is provided and the useful life of the crossbow (40) is prolonged.

Figure 6:
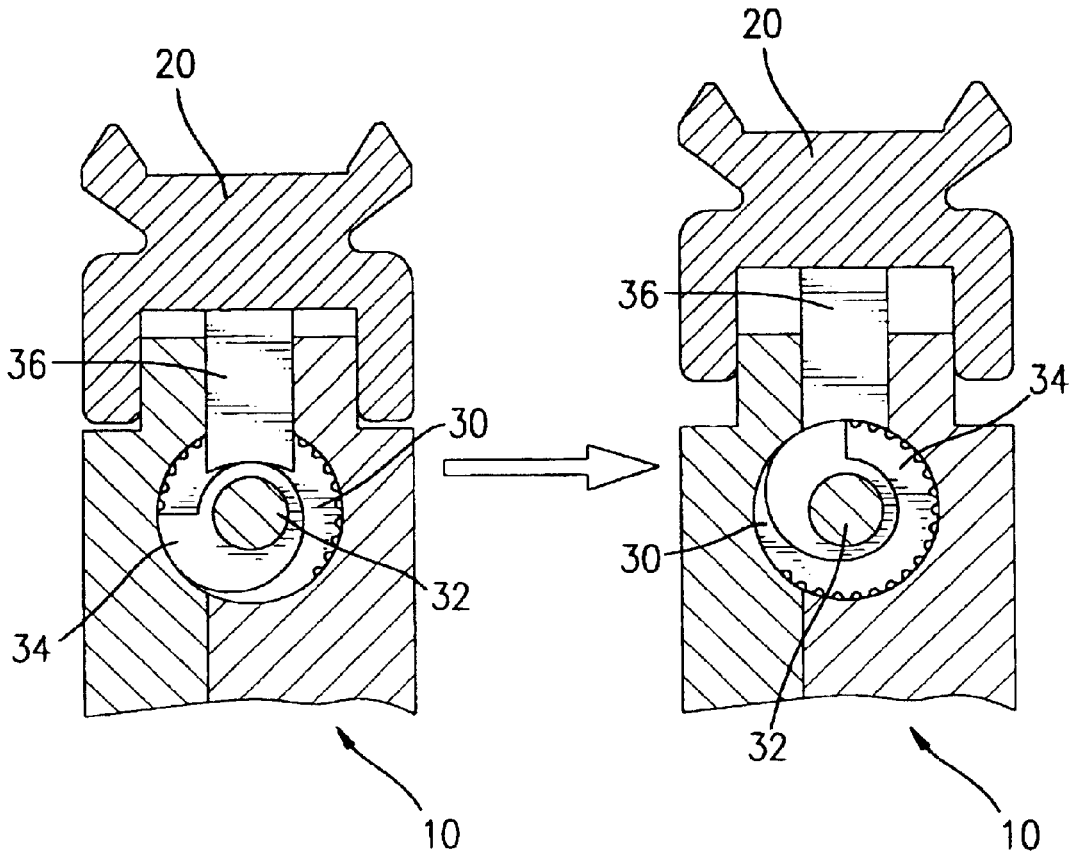
FIG. 6 is an operational front plan view of an adjusting device of the trigger assembly in FIG. 2 with the angle of the sight mount adjusted by rotating the adjustment knob.

With reference to FIGS. 1, 2 and 6, the optional sight mount (20) is attached to the top of the housing (10) to hold an aiming device (not shown) such as a scope to assist in aiming the crossbow (40) arrow at a target. The sight mount (20) is attached pivotally to the top of the housing (10) and has a bottom (not numbered), a pivot point (not numbered), a front segment (not numbered) and a rear segment (not numbered). The front segment is forward of the pivot point, and the rear segment is aft of the pivot point.

The adjusting device is mounted in the housing (10) to adjust the sight mount (20) vertically relative to the housing (10). The adjusting device comprises an adjustment knob (30), a pushing block (36) and a sight mount biasing member (22). The adjustment knob (30) is rotatably mounted in the rear end of the housing (10) and has a stub (32) and a cam (34). The stub (32) has an 6 outer periphery (not numbered) and rotatably extends into the housing (10). The cam (34) is formed on the outer periphery of the stub (32).

The pushing block (36) is mounted moveably in the housing (10) and has a top (not numbered) and a bottom (not numbered). The top of the pushing block (36) extends out from the top of the housing (10) and abuts the bottom of the sight mount (20) in the rear segment. The bottom of the pushing block (36) is concave and abuts the cam (34) on the adjustment knob (30). The sight mount biasing member (22) is mounted between the top of the housing (10) and the bottom of the sight mount (20) at the front segment.

Rotating the adjustment knob (30) causes the cam (34) to move the pushing block (36) up or down. Consequently, the rear segment of the sight mount (20) can be pushed up by the pushing block (36) or down by the sight mount biasing member (22), and the vertical alignment of the sight mount relative to the housing (10) is changed. Accordingly, the vertical alignment of an aiming device attached to the sight mount (20) can be adjusted conveniently and easily.

With reference to FIGS. 1, 2 and 5, the optional resilient arrow retainer (11) is mounted on the top of the housing (10) and extends downward to correspond to the mouth (102) in the housing (10). When an arrow (50) is put on the stock (42) of the crossbow (40), the resilient arrow retainer (1) will press against the arrow (50) to make the travel of the arrow (50) on the stock (42) smooth.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A trigger assembly for a crossbow having a stock and a transverse bow with a bowstring, the trigger assembly comprising:

a housing adapted to be mounted on the stock and having a top, a bottom, a front end, a rear end, a side, a mouth with a top and a bottom defined transversely in the front end and a slot defined transversely through the side and parallel to the mouth;

a trigger mounted pivotally in the housing and having a top portion and a bottom portion that protrudes out from the bottom of the housing;

an actuating lever mounted pivotally in the housing, abutting the top portions of the trigger and having a front end with a hook and a rear end;

a bowstring catch mounted pivotally in the housing and having a front end, a rear end, a string hook formed on the front end and corresponding to the mouth in the housing and a leg extending downward from the rear end and selectively engaging the hook on the actuating lever;

a bowstring catch biasing member mounted in the housing between the top of the housing and the bowstring catch to pivot the string hook out of the mouth;

a safety pin mounted moveably in the housing and having a top and a bottom that is supported on the rear end of the actuating lever;

a safety lock mounted moveably in the housing and having a front end, a rear end corresponding to and selectively abutting the top of the safety pin and a push rod extending transversely from the safety lock and out of the slot in the housing;

a pushing arm mounted moveably in the housing and having a bottom, a front end corresponding to the mouth in the housing, a rear end and a protrusion abutting the push rod on the safety lock;

a block mounted pivotally in the housing and having a transverse rod extending transversely from the block and selectively engaged by the front end of the pushing arm;

a block biasing member mounted in the housing and connected to the block to push the block into the mouth when the transverse rod on the block disengages from the front end of the pushing arm; and a string stop mounted pivotally in the housing, extending into the mouth and corresponding to the block.

2. The trigger assembly as claimed in claim 1, wherein the housing is composed of two half shells attached to each other.

3. The trigger assembly as claimed in claim 2, wherein the pushing arm further has a notch defined in the bottom at the front end to selectively engage the transverse rod on the block.

4. The trigger assembly as claimed in claim 3, wherein the mouth has a top and a bottom;

the block is pivotally mounted in the housing at the bottom of the mouth and has a top selectively extending into the mouth and a bottom;

the second biasing member has one end connected to the bottom of the block; and the string stop is pivotally mounted in the housing at the top of the mouth.

5. The trigger assembly as claimed in claim 4 further comprising a sight mount mounted on the top of the housing to support an aiming device.

6. The trigger assembly as claimed in claim 5, wherein the sight mount is pivotally attached to the top of the housing and has a bottom, a pivot point, a front segment forward of the pivot point and a rear segment aft of the pivot point; and an adjusting device is mounted in the housing to adjust the sight mount vertically relative to the housing, and the adjusting device comprises an adjustment knob rotatably mounted in the rear end of the housing and having a stub with an outer periphery rotatably extending into the housing and a cam formed on the outer periphery of the stub;

a pushing block mounted moveably in the housing and having a top extending out from the top of the housing and abutting the bottom of the sight mount in the rear segment and a concave bottom abutting the cam on the adjustment knob; and a sight mount biasing member mounted between the top of the housing and the bottom of the sight mount at the front segment.

7. The trigger assembly as claimed in claim 6 further comprising a resilient arrow retainer mounted on the top of the housing and extending downward to correspond to the mouth in the housing.

8. The trigger assembly as claimed in claim 1, wherein the pushing arm further has a notch defined in the bottom at the front end to selectively engage the transverse rod on the block.

9. The trigger assembly as claimed in claim 8, wherein the sight mount is pivotally attached to the top of the housing and has a bottom, a pivot point, a front segment forward of the pivot point and a rear segment aft of the pivot point; and an adjusting device is mounted in the housing to adjust the sight mount vertically relative to the housing, and the adjusting device comprises an adjustment knob rotatably mounted in the rear end of the housing and having a stub with an outer periphery rotatably extending into the housing and a cam formed on the outer periphery of the stub;

a pushing block mounted moveably in the housing and having a top extending out from the top of the housing and abutting the bottom of the sight mount in the rear segment and a concave bottom abutting the cam on the adjustment knob; and a sight mount biasing member mounted between the top of the housing and the bottom of the sight mount at the front segment.

10. The trigger assembly as claimed in claim 1, wherein the mouth has a top and a bottom;

the block is pivotally mounted in the housing at the bottom of the mouth and has a top selectively extending into the mouth and a bottom;

the second biasing member has one end connected to the bottom of the block; and the string stop is pivotally mounted in the housing at the top of the mouth.

11. The trigger assembly as claimed in claim 1 further comprising a sight mount mounted on the top of the housing to support an aiming device.

12. The trigger assembly as claimed in claim 1 further comprising a resilient arrow retainer mounted on the top of the housing and extending downward to correspond to the mouth in the housing.

* * * * *